US006050335A

United States Patent [19]

Parsons

[11] Patent Number: 6,050,335

[45] Date of Patent: Apr. 18, 2000

[54] IN-SITU PRODUCTION OF BITUMEN

[75] Inventor: Leslie James Parsons, Calgary, Canada

[73] Assignee: Shell Oil Company, Houston, Tex.

[21] Appl. No.: 09/178,910

[22] Filed: Oct. 26, 1998

[30] Foreign Application Priority Data

Oct. 31, 1997 [CA] Canada ..... 2219806

[51] Int. Cl.[7] ..... E21B 43/24

[52] U.S. Cl. ..... 166/272.3; 166/50; 166/263; 166/272.7

[58] Field of Search ..... 166/57, 272.3, 166/272.7, 263, 303, 50

[56] References Cited

U.S. PATENT DOCUMENTS 4,248,302 2/1981 Churchman ..... 166/272.1
4,344,485 8/1982 Butler ..... 166/271
5,339,904 8/1994 Jennings Jr., et al. ..... 166/303
5,511,616 4/1996 Bert ..... 166/272.7

FOREIGN PATENT DOCUMENTS 1173353 8/1984 Canada .

*Primary Examiner*—William Neuder
*Assistant Examiner*—John Kreck

[57] ABSTRACT

A system for in-situ production of bitumen comprises a steam injection well system which comprises a number of lateral sections that traverse the bitumen bearing formation partly above a basal water transition and/or thief zone such that a tip of each lateral section protrudes from the bitumen bearing formation into the basal water transition and/or thief zone.

16 Claims, 2 Drawing Sheets

IN-SITU PRODUCTION OF BITUMEN

FIELD OF THE INVENTION

The invention relates to a method ard system for in-situ production of bitumen wherein steam is injected into the bitumen bearing formation to transfer heat to the in-situ bitumen so that it will melt and move to one or more producer wells and ultimately to surface.

BACKGROUND OF THE INVENTION

Many steam stimulation, steam drive and gravity drainage schemes (and combinations thereof) have been suggested to produce in-situ bitumen. Designers of these schemes have typically sought to promote the mass transfer of the steam into the areas of the reservoir in which bitumen is thought to be present. Steam stimulation typically involves drilling wells into an underground bitumen deposit and using the wells sequentially for steam injection and then for production, which is called a steam soak cycle. Mass transfer of steam into the deposit may be promoted by fracturing the reservoir. Steam drive and gravity drainage schemes make use of steam injection wells and production wells simultaneously. Mass transfer of the steam can take the form of a communication path or steam breakthrough from the injection well(s) to the production well(s). The flow of steam warms the adjacent bitumen and encourages it to flow toward the production well(s). Alternatively the steam is encouraged into the deposit to create a steam chamber that grows from the injection well(s) to the production well(s). In any event, leakage of steam to a basal water transition zone or elsewhere in the reservoir where the bitumen saturation level is low (hereinafter called "thief zones") has been avoided as being a waste of heat energy and as being unproductive.

Canadian patent specification 2,015,459 discloses a process for confining steam injected into a heavy oil reservoir having a thief zone, wherein a pressurized non-condensable gas is injected into the thief zone to inhibit the escape of injected steam through that zone.

U.S. Pat. No. 4,344,485 and Canadian patent specification 1,304,287 disclose steam assisted gravity drainage processes wherein steam is injected via an upper horizontal well section to transfer heat to the normally immobile heavy oil so that it will melt and will drain by gravity to a lower horizontal well section where the oil is recovered.

U.S. Pat. No. 4,390,067 discloses the use of a rectangular grid of horizontal steam injection wells to create heated corridors in a viscous oil or bitumen bearing formation from which viscous oil or bitumen is then produced via vertical production wells.

U.S. Pat. No. 4,702,314 discloses an oil production system comprising a rectangular four spot production well pattern and a vertical steam injection well at the centre of the pattern, wherein the production wells comprise horizontal inflow sections that point towards the steam injection well.

U.S. Pat. No. 4,283,088 discloses a thermal oil mining method wherein a series of steam injection and oil production wells is drilled in an upward direction and in a star-shaped configuration into the oil bearing formation from a ring-shaped working tunnel which is located near the bottom of said formation.

It is an object of the present invention to provide a method and system for in-situ production of bitumen which promotes the mobility of bitumen in larger volumes of the bitumen bearing formation than has been previously possible.

SUMMARY OF THE INVENTION

The system according to the invention thereto comprises a steam injection well system which comprises a number of lateral sections that traverse the bitumen bearing formation partly above a thief zone such that a tip of each lateral section protrudes from the bitumen bearing formation into the thief zone.

DETAILED DESCRIPTION

The method according to the invention comprises injecting steam via the steam injection well system into the bitumen bearing formation and the thief zone so as to build up a steam chamber which grows from the tip towards a heel of each lateral section of the steam injection well system.

The injection of steam into the thief zone is opposed to the previous teachings and has been adapted to promote heat distribution in the vicinity of the end of the lateral sections of the steam injection well system and to reduce the amount of water in the produced fluids. It is thought that this technique is more efficient because it enables steam chamber growth at an unprecedented rate from the tip towards the heel of each lateral section of the steam injection system and therefore promotes the mobility of bitumen in larger volumes of the reservoir than has been previously possible.

Preferably, the steam injection well system comprises a plurality of substantially radial lateral sections which are linked to a wellhead via a number of substantially vertical upper sections such that, when seen from above, said lateral sections traverse the bitumen bearing formation in a star-shaped pattern away from the wellhead.

Furthermore it is preferred that a group of four lateral steam injection sections is linked to the wellhead and adjacent lateral steam injection sections traverse the bitumen bearing formation in substantially orthogonal directions and that the system comprises a pair of substantially parallel and horizontal production wells and a steam injection well system which comprises, when seen from above, a plurality of wellheads which are located at substantially equal distances from the production wells and which are each linked to four lateral steam injection sections which cross said production wells at an angle between 30° and 60°.

In that case it is also preferred that one or more substantially horizontal production wells are drilled after several steam soak cycles have been carried out via the steam injection well system and that these production wells cross the lateral steam injection sections at selected distances.

These and further features, objects and advantages of the method and system according to the invention will become apparent from the following claims, abstract and detailed description with reference to the drawings.

Figure 1:
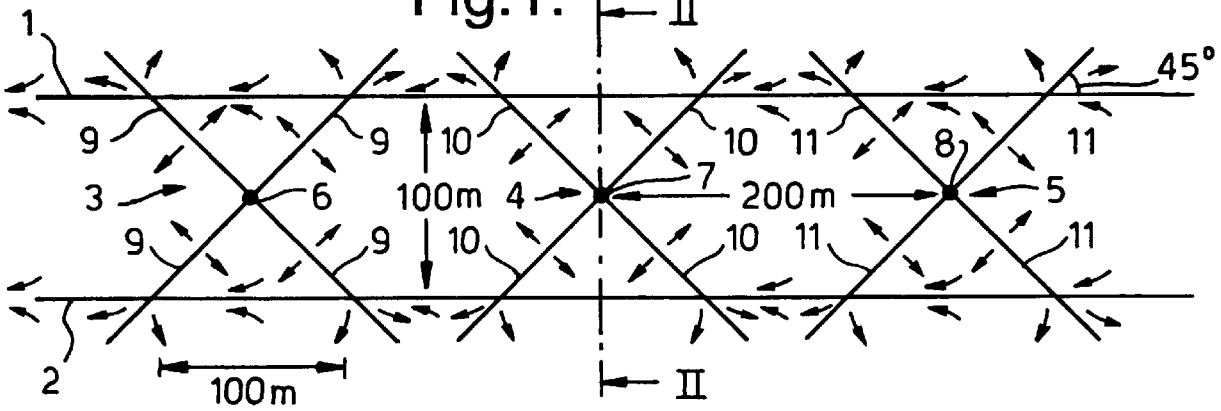
FIG. 1 shows a plan view, seen from above, of a well system according to the invention which comprises two parallel bitumen production wells and three steam injection well systems.

Referring now to FIG. 1 there is shown a gravity assisted drainage system for in-situ bitumen production according to the invention.

The system comprises two substantially parallel horizontal production wells 1 and 2 and three multilateral steam injection well systems 3, 4 and 5. Each system 3, 4 and 5 comprises a wellhead 6, 7 and 8, respectively, which is connected to four lateral steam injection sections 9, 10 and 11, respectively.

These lateral steam injection sections 9, 10 and 11 extend in a radial direction away from the wellheads 6, 7 and 8 in orthogonal directions such that each of the lateral sections 9, 10 and 11 crosses one of the production wells 1, 2 at an angle of between 30° and 60°, which angle is in the example shown 45°.

The distance between the parallel production wells 1 and 2 is about 100 m and the wellheads 6, 7 and 8 of the steam injection systems 3, 4 and 5 are located halfway between the production wells 1 and 2 and at mutual distances of about 200 m so that the lateral sections 9, 10 and 11 cross the production wells at regular intervals of about 100 m.

Figure 2:
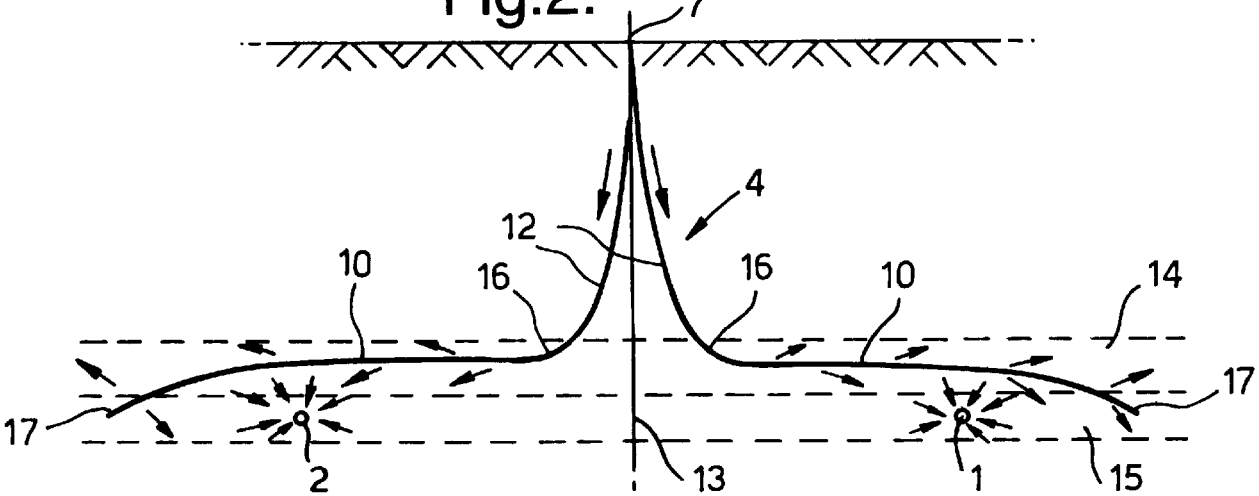
FIG. 2 shows, at an enlarged scale, a vertical sectional view of the system of FIG. 2, taken along phantom line II—II.

FIG. 2 shows in more detail the steam injection system 4 at the centre of FIG. 1. As shown in FIG. 2 the lateral steam injection sections 10 are connected to the wellhead 7 by substantially vertical upper sections 12. Furthermore, a substantially vertical pilot hole 13 is connected to the wellhead 7, which hole serves to accurately locate the depths of the bitumen bearing formation 14 and basal water zone 15.

The lateral steam injection sections 10 trend downwards over their length from their heel 16 towards their tip 17. Each lateral steam injection section 10 and vertical section 10 is completed with an un-cemented liner (not shown) which is tied back to the pilot hole 13. The liner is slotted over the length of the lateral steam injection section 10 to permit injection of steam into the bitumen bearing formation 14 and basal water zone 15.

The tip 17 of each lateral steam injection section 10 dips towards the basal water zone 15, which is a zone of increasing water saturation and steam injectivity.

The thermal recovery process is initiated before the horizontal wells 1 and 2 are drilled by injecting steam at high rate via the wellheads 6, 7 and 8 into the lateral steam injection sections 9, 10 and 11. Initially the majority of steam will flow via the tips 17 of the lateral steam injection sections 9, 10 and 11 in to the basal water zone 15, whereas lack of bitumen mobility limits heat transfer to conduction along the length of the other parts of these sections 9, 10 and The heat transferred by conduction into the bitumen bearing formation 14 will warm up and gradually mobilize bitumen in the vicinity of the lateral steam injection sections 9, 10 and 11.

Injection of steam via the wellheads 6, 7 and 8 is stopped after some time whereupon fluids are produced back via the steam injection well systems 3, 4 and 5, so that a steam-soak cycle is performed.

During the production phase of the steam soak cycle the rate of gravity drainage of bitumen into the lateral steam injection sections 9, 10 and 11 is sufficient to block condensing steam in the basal water zone 15 from entering the well systems 3, 4 and 5.

The steam soak cycle is then repeated one or more times. The bitumen mobility will gradually increase as a result of the subsequent steam soak cycles. Consequently steam chambers will build up along the lengths of the lateral sections 9, 10 and 11 which accelerates reservoir heating and well production rates.

Within these steam chambers rising steam contacts cold bitumen, condenses and an emulsion is created. During the production phase residual heat in the rock surrounding the lateral sections 9, 10 and 11 will vapourize water, thus returning steam to the chambers and resulting in low water cut production.

Throughout the steam injection phases of the initial steam soak cycles the majority of fluid loss continues to be in the basal water zone 15, however, the fraction of water in the produced fluid increase with steam chamber development.

Following two or more steam soak cycles, the horizontal wells 1 and 2 are drilled below the lateral steam injection sections 9, 10 and 11 such that the horizontal wells 1 and 2 cross these sections at a distance of several, preferably at least 3 meters and intersect the developed steam chambers.

The spacing of the horizontal production wells 1 and 2 at about 100 m and of the wellheads 6, 7 and 8 at about 200 m intervals, with the orthogonal radial steam injection sections 9, 10 and 11 crossing the horizontal wells 1 and 2, when seen from above at about 45° leads to the further development of steam chambers at 100 m intervals over the length of the horizontal production wells 1 and 2 thus reducing the likelihood of less than full utilization of the horizontal production wells 1 and 2.

The large spacing of 100 m between the parallel horizontal production wells reduces the drilling capital and will improve ultimate recovery of the bitumen resource.

The performance of a set of three steam injection well systems 3, 4 and 5 drilled into the Peace River bitumen deposit in Alberta, Canada has been encouraging. During two steam soak cycles the well systems 3, 4 and 5 have produced more than 50000 $m^3$ of bitumen at a bitumen-steam ratio more than 0.4.

Subsequently a third steam soak cycle has been completed. The overall result of the three steam soak cycles is that more than 90,000 $m^3$ of bitumen has been produced at a bitumen-steam ratio of more than 0.42.

The Peace River in-situ oil sand deposit is in a formation that contains water in varying concentrations. In the upper regions in the formation, bitumen saturation levels are high and they decline toward the lower regions in the formation. Conversely, the water saturation levels are low in the upper levels in the formation and increase toward the lower levels of the formation. At a certain depth, the water saturation levels are sufficiently high that the water becomes mobile. The lower part of the formation, containing this mobile water, acts as a thief for injected steam, and prograsses into a basal water transition zone (15).

Figure 3:
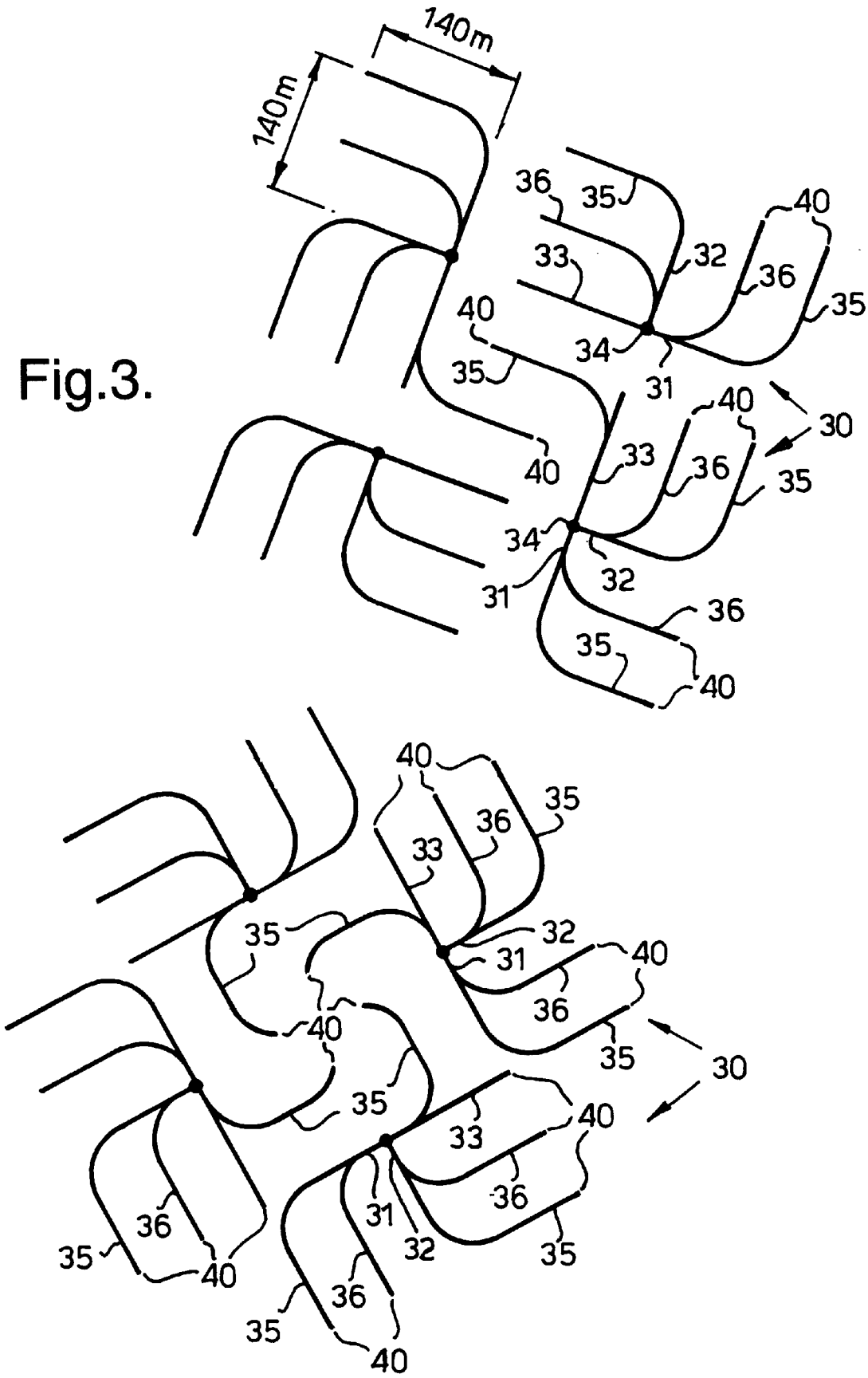
FIG. 3 shows a plan view, seen from above, of two adjacent clusters of four well systems according to the invention.

Referring now to FIG. 3 there is shown an alternative well configuration where two sets of four well systems 30 according to the invention traverse in substantially horizontal directions through a bitumen bearing formation.

Each well system comprises three radial sections 31, 32, 33 that have been drilled away from a substantially vertical central riser section 34 that leads to a central wellhead which in the plan view of the drawing coincides with the riser section 34.

From at least two of the radial sections 31, 32, 33 a set of one or two tangential sections 35, 36 has been drilled in a left hand or other predetermined orientation such that the tip 40 of each tangential section 35, 36 protrudes downwardly from the bitumen bearing formation into a thief zone at the bottom of the bitumen bearing formation or through the thief zone into a basal water transition zone which is located below the thief zone.

The well pattern shown in FIG. 3 generates clusters of substantially regularly spaced and distributed radial and tangential lateral well sections 31–36, via which steam is injected in an evenly distributed manner into the bitumen bearing formation and via the tips 40 of these wells into the underlying thief and/or basal water transition zone.

Preferably the same well systems 30 are used for production of bitumen after steam has been injected through the well systems 30, so that a steam soak cycle is carried out. The seam soak cycle may be repeated several times until a major part of the bitumen has been mobilized and recovered.

I claim:

1. A system for in-situ bitumen production comprising a steam injection well system which comprises a number of lateral sections that traverse the bitumen bearing formation partly above a thief zone such that a tip of each lateral section protrudes from the bitumen bearing formation into the thief zone.

2. The system of claim 1, wherein the system further comprises one or more substantially horizontal production wells which cross said lateral sections at selected distances.

3. The system of claim 1, wherein the tips of the lateral sections have a downwardly sloping orientation.

4. The system of claim 1, wherein the steam injection well system comprises a plurality of at least partly radial lateral sections which are linked to a wellhead via a number of substantially vertical upper sections such that, when seen from above, said lateral sections traverse the bitumen bearing formation in a star-shaped pattern away from the wellhead.

5. The system of claim 4, wherein a group of four lateral steam injection sections is linked to the wellhead and adjacent lateral steam injection sections traverse the bitumen bearing formation in substantially orthogonal directions.

6. The system of claim 1, wherein the tip of each lateral section protrudes from the bitumen hearing formation through the thief zone into a basal water transition zone.

7. A method for in-situ bitumen production with the system of claim 1, said method comprising injecting steam via the steam injection well system into the bitumen bearing formation and the thief zone so as to build up a steam chamber which grows from the tip towards a heel of each lateral section of the steam injection well system.

8. The method of claim 7, wherein said steam is injected via the steam injection well system into the bitumen bearing formation, the thief zone and into a basal water transition zone underlying the thief zone.

9. The method of claim 7, wherein a steam soak cycle is carried out by sequentially injecting steam into, and producing a hot bitumen carrying fluid from, the steam injection well system.

10. The method of claim 9, further comprising drilling one or more substantially horizontal production wells after several steam soak cycles have been carried out via the steam injection well system.

11. A steam injection system for in-situ bitumen production comprising a number of lateral sections that traverse a bitumen bearing formation partly above a thief zone such that a tip of each lateral section protrudes from the bitumen bearing formation into the thief zone; and a pair of substantially parallel and horizontal production wells which cross said lateral sections at selected distances; wherein said steam injection well system, when seen from above, further comprises a plurality of wellheads which are located at substantially equal distances from the production wells and which are each linked to four lateral steam injection sections which cross production wells at an angle between 30° and 60°.

12. The system of claim 11, wherein the distance between adjacent wellheads of the steam injection system is between 1.8 and 2.2 times the average distance between the production wells and said angle is between 40° and 50°.

13. The system of claim 12, wherein the average distance between the production wells is between 90 and 110 m, the distance between adjacent wellheads of the steam injection system is between 190 and 210 m, and the distance at which the lateral steam injection sections cross the inflow sections is at least 3 m.

14. A steam injection system for in-situ bitumen production comprising a plurality of partly radial lateral sections that traverse a bitumen bearing formation partly above a thief zone such that a tip of each lateral section protrudes from the bitumen bearing formation into the thief zone and which are linked to a wellhead via a number of substantially vertical upper sections such that, when seen from above, said lateral sections traverse the bitumen bearing formation in substantially orthogonal directions in a star-shaped pattern away from the wellhead; and a pair of substantially parallel and horizontal production wells; wherein said steam injection well system, when seen from above, further comprises a plurality of wellheads which are located at substantially equal distances from the production wells and which are each linked to four lateral steam injection sections which cross said production wells at an angle between 30° and 60°.

15. The system of claim 14, wherein the distance between adjacent wellheads of the steam injection system is between 1.8 and 2.2 times the average distance between the production wells and said angle is between 40° and 50°.

16. The system of claim 15, wherein the average distance between the production wells is between 90 and 110 m, the distance between adjacent wellheads of the steam injection system is between 190 and 210 m, and the distance at which the lateral steam injection sections cross the inflow sections is at least 3 m.

* * * * *